US009721724B2

(12) United States Patent
Obata

(10) Patent No.: US 9,721,724 B2
(45) Date of Patent: Aug. 1, 2017

(54) METHOD FOR PRODUCING R-T-B SINTERED MAGNET

(75) Inventor: Tohru Obata, Yabu (JP)

(73) Assignee: HITACHI METALS, LTD., Tokyo (JP)

( * ) Notice: Subject to any disclaimer, the term of this patent is extended or adjusted under 35 U.S.C. 154(b) by 981 days.

(21) Appl. No.: 13/822,659

(22) PCT Filed: Aug. 5, 2011

(86) PCT No.: PCT/JP2011/067946
§ 371 (c)(1),
(2), (4) Date: Mar. 13, 2013

(87) PCT Pub. No.: WO2012/043061
PCT Pub. Date: Apr. 5, 2012

(65) Prior Publication Data

US 2013/0181039 A1 Jul. 18, 2013

(30) Foreign Application Priority Data

Sep. 30, 2010 (JP) ..... 2010-220534
Jun. 30, 2011 (JP) ..... 2011-145412

(51) Int. Cl.
*H01F 41/00* (2006.01)
*C22C 38/00* (2006.01)
(Continued)

(52) U.S. Cl.
CPC ..... *H01F 41/00* (2013.01); *C22C 33/02* (2013.01); *C22C 38/002* (2013.01);
(Continued)

(58) Field of Classification Search
None
See application file for complete search history.

(56) References Cited

U.S. PATENT DOCUMENTS 6,280,792 B1 * 8/2001 Tochishita ..... C23C 14/505 118/729
2006/0231163 A1 * 10/2006 Hirosawa et al. ..... 148/105
(Continued)

FOREIGN PATENT DOCUMENTS

JP 040143221 * 5/1992 ..... C21D 8/12
JP 2007-329250 A 12/2007
(Continued)

OTHER PUBLICATIONS

English translation of Official Communication issued in corresponding International Application PCT/JP2011/067946, issued on Apr. 9, 2013.

(Continued)

*Primary Examiner* — Mandy Louie
(74) *Attorney, Agent, or Firm* — Keating & Bennett, LLP

(57) ABSTRACT

[Problem] To provide a highly efficient manufacturing method including an RH supply-diffusion process by which the number of magnets processed at a time can be increased without allowing sintered R-T-B based magnets to stick to holding members.

[Solution] A method for producing a sintered R-T-B based magnet including the steps of: forming a stack of RH diffusion sources and sintered R-T-B based magnet bodies by stacking the diffusion sources and the magnet bodies alternately with a holding member having openings interposed; and carrying out an RH supply-diffusion process by loading the stack into a process vessel and creating an atmosphere with a pressure of 0.1 Pa to 50 Pa and a temperature of 800° C. to 950° C. within the process vessel.

4 Claims, 5 Drawing Sheets

(51) Int. Cl.

| | |
|---|---|
| ***C22C 38/06*** | (2006.01) |
| ***C22C 38/10*** | (2006.01) |
| ***C22C 38/16*** | (2006.01) |
| ***H01F 41/02*** | (2006.01) |
| ***C22C 33/02*** | (2006.01) |
| *H01F 1/057* | (2006.01) |

(52) U.S. Cl.

CPC ..... *C22C 38/005* (2013.01); *C22C 38/06* (2013.01); *C22C 38/10* (2013.01); *C22C 38/16* (2013.01); *H01F 41/0293* (2013.01); *C22C 2202/02* (2013.01); *H01F 1/0577* (2013.01)

(56) References Cited

U.S. PATENT DOCUMENTS

| | | | | |
|---|---|---|---|---|
| 2008/0286595 | A1* | 11/2008 | Yoshimura et al. | 428/548 |
| 2010/0182113 | A1* | 7/2010 | Yoshimura | B22F 3/24 335/302 |
| 2010/0239878 | A1* | 9/2010 | Nagata et al. | 428/548 |
| 2012/0114844 | A1* | 5/2012 | Odaka et al. | 427/127 |

FOREIGN PATENT DOCUMENTS

| | | | | |
|---|---|---|---|---|
| JP | 2007329250 | * | 12/2007 | H01F 41/02 |
| JP | 2009-135393 | A | 6/2009 | |
| JP | 2009-200180 | A | 9/2009 | |
| JP | 2011233554 | * | 11/2011 | H01F 1/053 |
| WO | 2009/104640 | A1 | 8/2009 | |
| WO | WO2011004867 | * | 1/2011 | B22F 3/24 |

OTHER PUBLICATIONS

Official Communication issued in International Patent Application No. PCT/JP2011/067946, mailed on Nov. 8, 2011.

* cited by examiner (a)

(b)

METHOD FOR PRODUCING R-T-B SINTERED MAGNET

TECHNICAL FIELD

The present invention relates to a method for producing a sintered R-T-B based magnet (where R is at least one of the rare-earth elements and T is at least one of the transition metal elements and always includes Fe) including an $R_2T_{14}B$ type compound as a main phase.

BACKGROUND ART

A sintered R—Fe—B based magnet, including an $R_2T_{14}B$ type compound as a main phase, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity $H_{cJ}$ (which will be simply referred to herein as "$H_{cJ}$") at high temperatures, such a magnet will cause an irreversible flux loss. For that reason, when used in a motor, for example, the magnet should maintain $H_{cJ}$ that is high enough even at elevated temperatures to minimize the irreversible flux loss.

It is known that if R in the $R_2T_{14}B$ type compound phase is partially replaced with a heavy rare-earth element RH (Dy, Tb), $H_{cJ}$ of a sintered R-T-B based magnet will increase. It is effective to replace a significant percentage of R in the $R_2T_{14}B$ type compound phase in the sintered R-T-B based magnet with such a heavy rare-earth element RH to achieve high $H_{cJ}$ even at a high temperature.

However, if the light rare-earth element RL (Nd, Pr), which is R in a sintered R-T-B based magnet, is replaced with the heavy rare-earth element RH, $H_{cJ}$ certainly increases but the remanence $B_r$ (which will be simply referred to herein as "$B_r$") decreases instead, which is a problem. Furthermore, as the heavy rare-earth element RH is one of rare natural resources, its use should be cut down.

Thus, in order to increase $H_{cJ}$ of a sintered R-T-B based magnet, a method for increasing $H_{cJ}$ while minimizing a decrease in $B_r$ by supplying a heavy rare-earth element RH such as Dy or Tb onto the surface of a sintered magnet using some evaporation means and then by making that heavy rare-earth element RH diffuse inside of the magnet has been proposed recently.

Patent Document No. 1 discloses a so-called "evaporation diffusion process" in which sintered R-T-B based magnet bodies 1 and RH diffusion sources 2, including a heavy rare-earth element RH, are arranged in a process chamber 11 so as to be spaced from each other as shown in FIG. 7 using a sintered magnet body holding member 3 (which may be an Nb net), a diffusion source holding member 4 and spacer members 12 and are heated to a predetermined temperature. In this manner, the heavy rare-earth element RH can be diffused inside of the sintered R-T-B based magnet bodies 1 while being supplied from the RH diffusion sources 2 onto the surface of the sintered R-T-B based magnet bodies 1.

According to the method disclosed in Patent Document No. 2, a vaporizable metallic material including at least one of Dy and Tb and sintered R-T-B based magnets are housed in a process vessel and are heated to a predetermined temperature within a vacuum atmosphere, thereby vaporizing and depositing the vaporizable metallic material on the sintered R-T-B based magnets and diffusing Dy and Tb atoms of the deposited metallic material over the surface and/or through the crystal grain boundaries of that sintered magnets.

According to Patent Document No. 2, the vaporizable metallic material and the sintered R-T-B based magnets are vertically stacked one upon the other with spacers interposed between them. Each of those spacers is obtained by patterning a wire rod into a grid shape and attaching a supporting member, which is bent substantially perpendicularly upward, to its outer periphery. Using spacers with such a supporting member, the vaporizable metallic material and the sintered R-T-B based magnets are arranged so as to be spaced apart from each other.

CITATION LIST

Patent Literature

Patent Document No. 1: PCT International Application Publication No. WO 2007/102391

Patent Document No. 2: Japanese Laid-Open Patent Publication No. 2009-135393

SUMMARY OF INVENTION

Technical Problem

According to Patent Documents Nos. 1 and 2, by utilizing the diffusion reaction caused by the heat treatment, a layer including the heavy rare-earth element RH in a high concentration is formed on the outer periphery of the main phase of the sintered R-T-B based magnets. In the meantime, the heavy rare-earth element RH diffuses deep inside of the sintered R-T-B based magnets from their surface, while a liquid phase component, which consists mainly of a light rare-earth element RL included in the sintered R-T-B based magnets, diffuses toward the surface of the sintered R-T-B based magnets. In this manner, while the heavy rare-earth element RH is diffusing deep inside of the sintered R-T-B based magnets from their surface, the light rare-earth element RL is diffusing from inside toward the surface of the sintered R-T-B based magnets. As a result of such mutual diffusion, an eluted portion consisting mainly of the light rare-earth element RL is formed on the surface of the sintered R-T-B based magnets, and causes a reaction with the supporting member that supports the sintered R-T-B based magnets. Consequently, the sintered R-T-B based magnets will stick to the supporting member (which will be referred to herein as "sticking").

If the heavy rare-earth element RH were supplied to the sintered R-T-B based magnets too much, such mutual diffusion and sticking would occur frequently. Thus, to prevent the heavy rare-earth element RH from being supplied excessively to the sintered R-T-B based magnets, spacers are interposed according to Patent Documents Nos. 1 and 2 between the net on which the sintered R-T-B based magnets are mounted and the RH diffusion sources (corresponding to the vaporizable metallic material of Patent Document No. 2) and between the net on which the RH diffusion sources are mounted and the sintered R-T-B based magnets, thereby leaving some space there.

However, such space would cause obstruction to processing a lot of sintered R-T-B based magnets, which is a problem.

The present inventors perfected our invention in order to overcome such a problem by providing a highly efficient RH supply-diffusion process, by which an increased number of magnets can be processed at a time without causing sticking between the sintered R-T-B based magnets and the holding member.

Solution to Problem

A method for producing a sintered R-T-B based magnet according to the present invention includes the steps of: forming a stack of RH diffusion sources (which are made of a metal or alloy, of which at least 80 at % is a heavy rare-earth element RH that is at least one of Dy and Tb) and sintered R-T-B based magnet bodies (where R is at least one of the rare-earth elements and T is at least one of the transition metal elements and always includes Fe) by stacking the diffusion sources and the magnet bodies alternately with a holding member having an opening interposed; and carrying out an RH supply-diffusion process by loading the stack into a process vessel and creating an atmosphere with a pressure of 0.1 Pa to 50 Pa and a temperature of 800° C. to 950° C. within the process vessel.

In one preferred embodiment, the holding member has a thickness of 0.1 mm to 4 mm.

In one preferred embodiment, the method further includes the step of carrying out an RH diffusion process by creating an atmosphere with a pressure of 200 Pa to 2 kPa and a temperature of 800° C. to 950° C. in the process vessel after the RH supply-diffusion process has been carried out.

In one this embodiment, the method is characterized by decreasing the temperature in the process vessel to 500° C. at a cooling rate of 1° C. per minute to 15° C. per minute after either the RH supply-diffusion process or the RH diffusion process has been carried out.

In one preferred embodiment, the process vessel is evacuated using a rotary pump with or without a mechanical booster pump.

ADVANTAGEOUS EFFECTS OF INVENTION

According to the present invention, sticking does not occur between sintered R-T-B based magnets and a holding member. That is why sintered R-T-B based magnet bodies and RH diffusion sources can be directly stacked one upon the other with the holding member interposed between them. As a result, an increased number of sintered R-T-B based magnet bodies can be processed at a time and the productivity can be increased.

DESCRIPTION OF EMBODIMENTS

Figure 1:
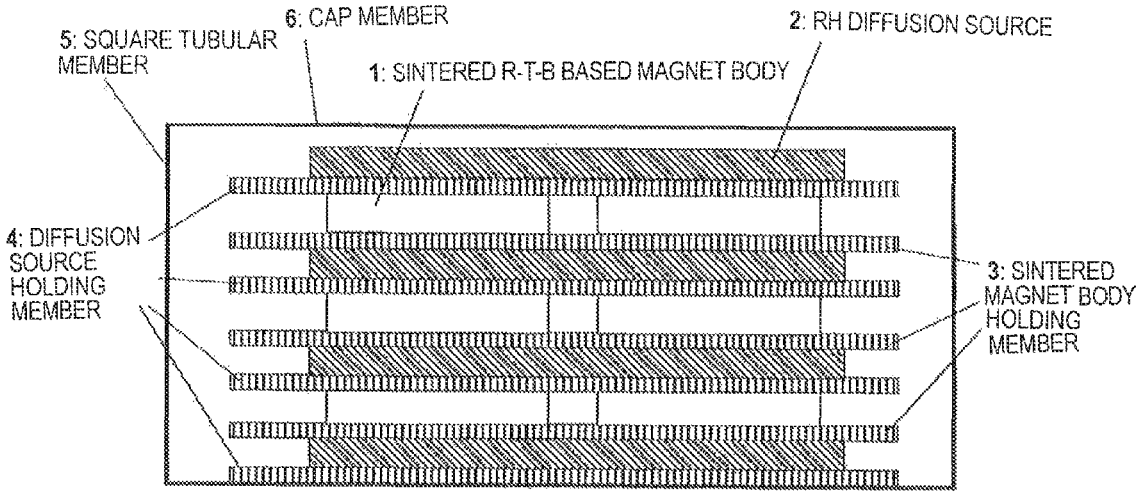
FIG. 1Illustrates an exemplary embodiment of the present invention.

According to the present invention, a process in which a heavy rare-earth element RH is made to diffuse inside a sintered R-T-B based magnet body while being supplied from an RH diffusion source onto the surface of the sintered R-T-B based magnet body will be referred to herein as an "RH supply-diffusion process". This RH supply-diffusion process is basically the same as the "evaporation diffusion" process disclosed in Patent Document No. 1 in the respect that a heavy rare-earth element RH is made to diffuse inside a sintered R-T-B based magnet body while being supplied from an RH diffusion source onto the surface of the sintered R-T-B based magnet body. On the other hand, a process in which a heavy rare-earth element RH is made to just diffuse inside a sintered R-T-B based magnet body without supplying the heavy rare-earth element RH from the RH diffusion source will be referred to herein as an "RH diffusion process".

Also, according to the present invention, a sintered R-T-B based magnet yet to be subjected to the RH supply-diffusion process will be referred to herein as a "sintered R-T-B based magnet body", while a sintered R-T-B based magnet that has been subjected to the RH supply-diffusion process will be referred to herein as a "sintered R-T-B based magnet" to avoid confusion.

Hereinafter, embodiments of the present invention will be described.

(sintered R-T-B based magnet body)

As the sintered R-T-B based magnet body, a magnet body which has a known composition and which has been produced by a known manufacturing process may be used.

For example, the sintered R-T-B based magnet body may be comprised of:

- 12 to 17 at % of R (which is at least one of the rare-earth elements);
- 5 to 8 at % of B (part of which may be replaced with C);
- 0 to 2 at % of additive element(s) (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and
- T (which is at least one of the transition metal elements and which always includes Fe) and inevitable impurities as the balance.

In this composition, the rare-earth element R consists essentially of a light rare-earth element RL, which is at least one element selected from the group consisting of Nd and Pr, but may possibly include at least one heavy rare-earth element RH selected from the group consisting of Dy and Tb.

(RH Diffusion Source)

The RH diffusion source is a metal or alloy, of which 80 at % or more is a heavy rare-earth element RH that is at least one of Dy and Tb. The RH diffusion source may be Dy metal, Tb metal, a Dy—Fe alloy or a Tb—Fe alloy, for example, and may include other additional elements other than Dy, Tb and Fe as well. The RH diffusion source suitably includes 80 at % or more of a heavy rare-earth element RH. The reason is that if the content of the heavy rare-earth element RH were less than 80 at %, the heavy rare-earth element RH would be supplied from the RH diffusion source at so low a rate that the process should be carried out for a very long time to achieve the effect of increasing $H_{cJ}$ as intended.

The RH diffusion source may have a plate shape, a block shape or any other arbitrary shape and its size is not particularly limited, either. Nevertheless, to increase the processing rate of the RH supply-diffusion process, it is recommended that a plate-like RH diffusion source with a thickness of 0.5 to 5.0 mm be used.

Unless the effects of the present invention are lessened, the RH diffusion source may include not only Dy and Tb but also at least one element selected from the group consisting of Nd, Pr, La, Ce, Zn, Zr, Sn, Co, Al, F, N and O.

(RH Supply-Diffusion Process Step)

According to the present invention, the pressure and temperature of the atmosphere inside the process vessel are set to fall within the range of 0.1 Pa to 50 Pa and the range of 800° C. to 950° C., respectively, in the RH supply-diffusion process step, thereby making the heavy rare-earth element RH diffuse inside of the sintered R-T-B based magnet body while supplying the heavy rare-earth element RH from the RH diffusion source onto the surface of the sintered R-T-B based magnet body without allowing the sintered R-T-B based magnet body to stick to a sintered magnet body holding member or a diffusion source holding member.

If the pressure inside the process vessel were lower than 0.1 Pa in the RH supply-diffusion process step, then the sintered R-T-B based magnet body would stick to the sintered magnet body holding member and to the diffusion source holding member. On the other hand, if the pressure were higher than 50 Pa, then the heavy rare-earth element RH could not be supplied to the sintered R-T-B based magnet body at a sufficiently high rate.

Furthermore, if the heat treatment temperature were lower than 800° C. in the RH supply-diffusion process step, then the heavy rare-earth element RH could not be supplied to the sintered R-T-B based magnet body at a sufficiently high rate. On the other hand, once the heat treatment temperature were higher than 950° C., the sintered R-T-B based magnet body would stick to the sintered magnet body holding member and the diffusion source holding member even if the pressure inside the process vessel falls within the range of 0.1 Pa to 50 Pa.

Hereinafter, the RH supply-diffusion process step will be described in detail.

FIG. 1 illustrates an exemplary embodiment of the present invention. In FIG. 1, inside a process vessel which is made up of a square tubular member 5 with an opening at the top and a cap member 6, sintered R-T-B based magnet bodies 1 and RH diffusion sources 2 are alternately stacked one upon the other with sintered magnet body holding members 3 and diffusion source holding members 4 interposed between them, thereby forming a stack. Specifically, on the bottom of the square tubular member, a diffusion source holding member 4, an RH diffusion source 2, a sintered magnet body holding member 3, a set of sintered R-T-B based magnet bodies 1, another diffusion source holding member 4, another RH diffusion source 2, another sintered magnet body holding member 3, another set of sintered R-T-B based magnet bodies 1 and so forth are stacked in this order one upon the other, thereby forming a stack. In this case, RH diffusion sources 2 are supposed to be arranged at the top and bottom of that stack (even though a holding member may be arranged under the bottom of the stack in some cases).

In this embodiment, no spacers are interposed as shown in FIG. 1 between a sintered magnet body holding member 3 on which the sintered R-T-B based magnet bodies 1 are mounted and a diffusion source holding member 4 on which the RH diffusion sources 2 are mounted unlike Patent Documents Nos. 1 and 2. That is why the sintered R-T-B based magnet bodies 1 and the RH diffusion sources 2 can be stacked alternately with only the sintered magnet body holding members 3 and the diffusion source holding members 4 interposed between them. Thus, by adjusting the thicknesses of the sintered magnet body holding members 3 and the diffusion source holding members 4, the gap between the sintered R-T-B based magnet bodies 1 and the RH diffusion source 2 can be controlled.

After such a stack has been formed in the process vessel, an RH supply-diffusion process is carried out with the pressure and temperature of the atmosphere in the process vessel set to fall within the range of 0.1 Pa to 50 Pa and the range of 800° C. to 950° C., respectively. The sintered R-T-B based magnet bodies 1 and the RH diffusion sources 2 are heated, thereby making the heavy rare-earth element RH diffuse inside the sintered R-T-B based magnet bodies 1 while supplying the heavy rare-earth element RH from the RH diffusion sources 2 onto the surface of the sintered R-T-B based magnet bodies 1.

Each of the sintered magnet body holding members 3 and diffusion source holding members 4 has openings. For example, an Mo net or a Nb net may be used as such a holding member. The holding member suitably has a thickness of 0.1 mm to 4 mm, for example. The reason is that if the thickness were less than 0.1 mm, the sintered R-T-B based magnets might stick to the holding member. According to the present invention, the RH supply-diffusion process is carried out with the pressure and temperature of the atmosphere in the process vessel set to fall within the range of 0.1 Pa to 50 Pa and the range of 800° C. to 950° C., respectively, and therefore, a lot of heavy rare-earth element RH will never be supplied from the RH diffusion sources 2. That is why if the thickness exceeded 4 mm, then the sintered R-T-B based magnet bodies 1 would be too distant from the RH diffusion sources 2 and the heavy rare-earth element RH would be supplied from the RH diffusion sources 2 to the sintered R-T-B based magnet bodies 1 at too low a rate to carry out the RH supply-diffusion process as intended. In order to carry out the RH supply-diffusion process efficiently, each holding member suitably has an opening ratio of 50% or more. The reason is that if the opening ratio were less than 50%, the heavy rare-earth element RH would be supplied from the RH diffusion sources 2 to the sintered R-T-B based magnet bodies 1 at an insufficient rate in the RH supply-diffusion process and could not diffuse in some regions. The opening ratio is more suitably 70% or more.

According to the present invention, the sintered magnet body holding members 3 and diffusion source holding members 4 do not have to bear the entire weight of the sintered R-T-B based magnet bodies 1 or RH diffusion sources 2, and therefore, their strength is not an important consideration. Specifically, it is recommended that a wire rod of Mo, Nb or W with a diameter of 2 mm or less be woven into the sintered magnet body holding members 3 and diffusion source holding members 4.

It should be noted that the sintered magnet body holding members 3 and the diffusion source holding members 4 do not have to have the same opening ratio and the same thickness. Nevertheless, it is still recommended that the sintered magnet body holding members 3 and the diffusion source holding members 4 have the same opening ratio and the same thickness because the sintered R-T-B based magnet bodies 1 can be subjected to the RH supply-diffusion process under the same condition vertically in that case.

Figure 2:
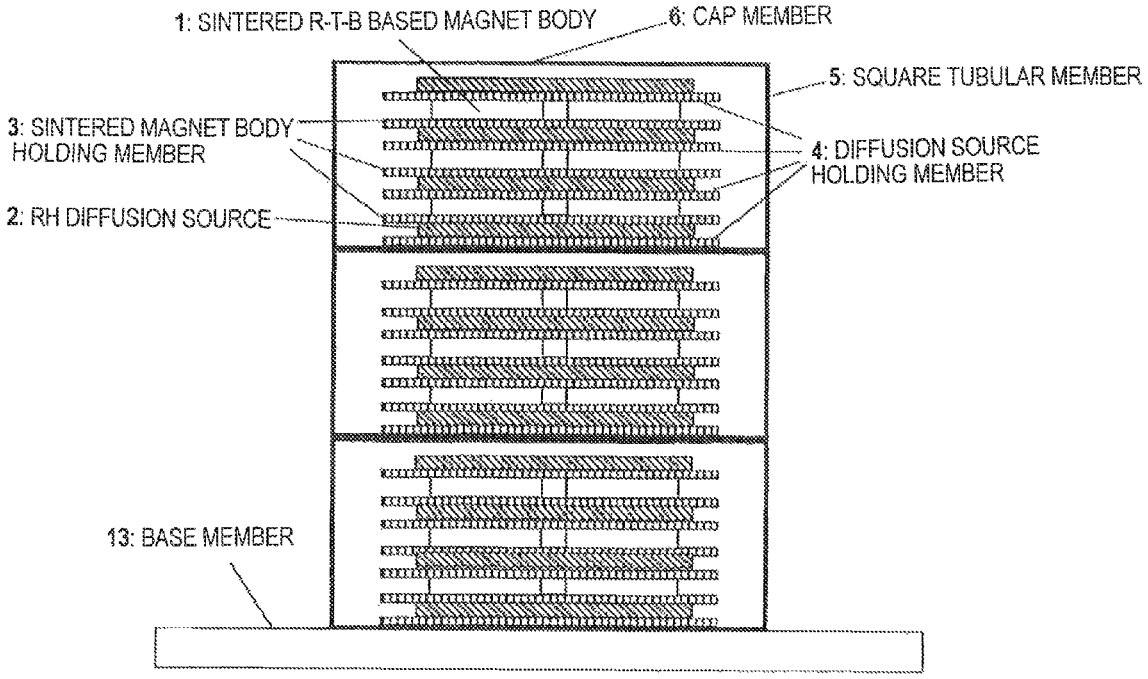
FIG. 2Illustrates an exemplary embodiment of the present invention.

Optionally, if a number of process vessels, each including the square tubular member 5 with or without the cap member 6, are vertically stacked one upon the other as shown in FIG. 2, a lot of sintered R-T-B based magnet bodies 1 and RH diffusion sources 2 can be stacked one upon the other. In this case, each square tubular member 5 may or may not have a bottom plate. If the square tubular member 5 has no bottom plate, then the cap member 6 serves as the bottom plate instead.

Figure 3:
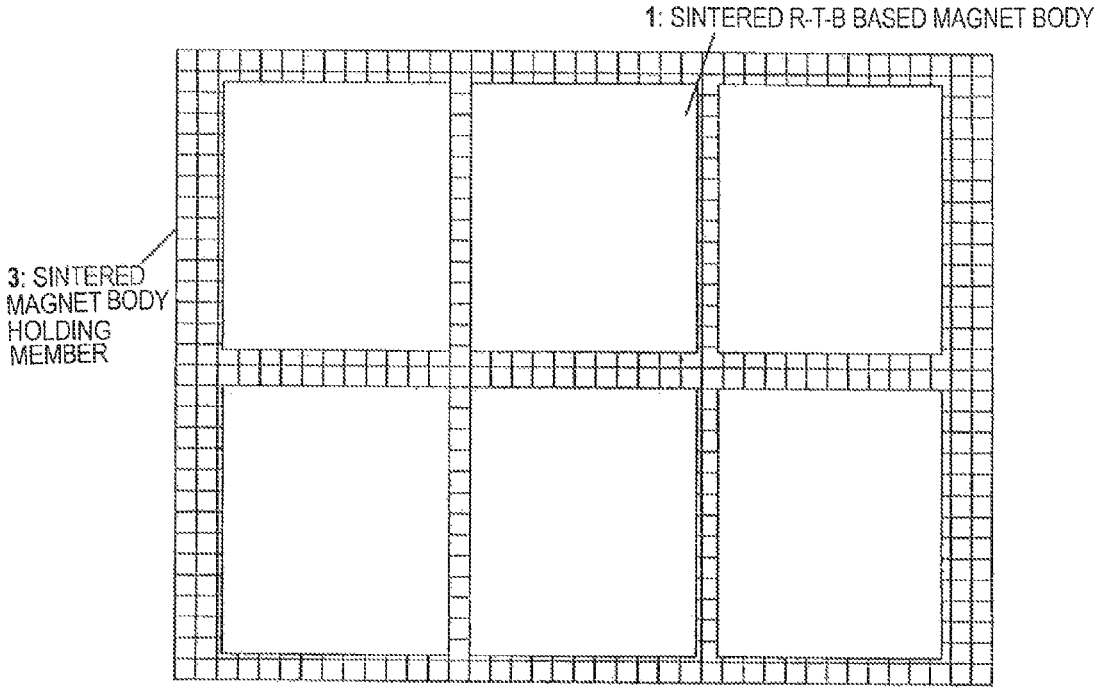
FIG. 3Illustrates an exemplary pattern in which sintered R-T-B based magnet bodies may be arranged on a sintered magnet body holding member.
Figure 4:
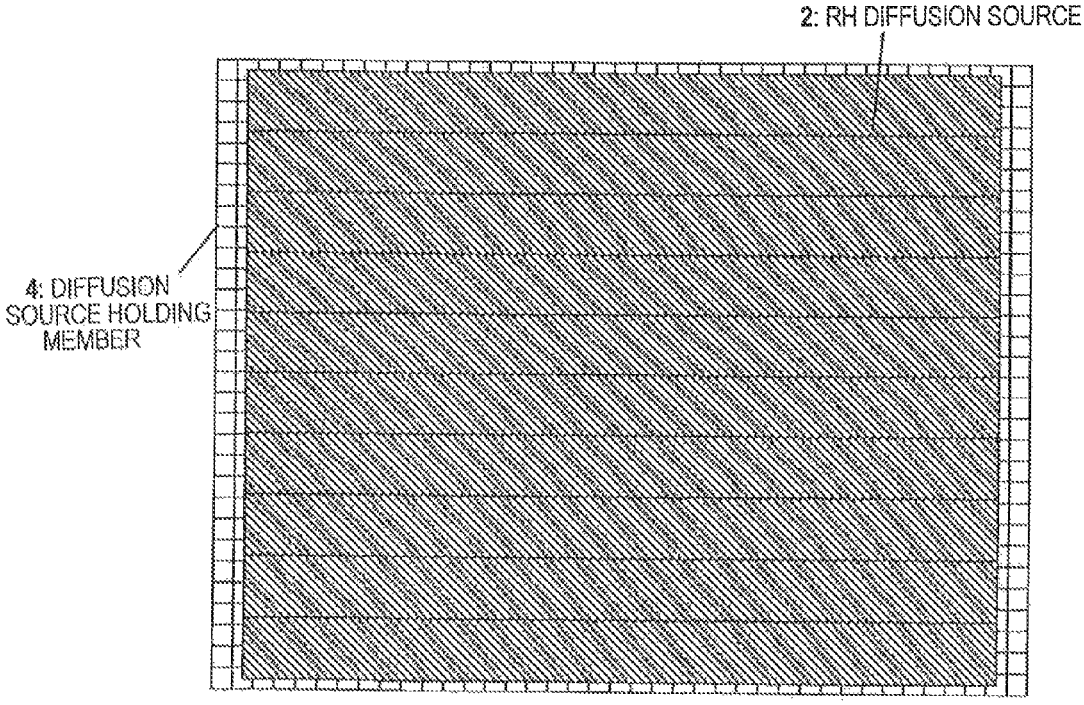
FIG. 4 Illustrates an exemplary pattern in which RH diffusion sources may be arranged on an RH diffusion source holding member.

Also, the sintered R-T-B based magnet bodies 1 are suitably spaced apart from each other as shown in FIG. 3 in order to prevent adjacent sintered R-T-B based magnet bodies 1 from sticking to each other with the light rare-earth element RL that has melted as a result of the RH supply-diffusion process. Meanwhile, the RH diffusion sources 2 may be arranged on the diffusion source holding member 4 with no gap left between them as shown in FIG. 4 or with a gap left between them, which may be determined appropriately depending on the arrangement of the sintered R-T-B based magnet bodies 1.

Since the RH supply-diffusion process step is carried out at an atmospheric gas pressure of 0.1 Pa to 50 Pa, the heavy rare-earth element RH would not supplied excessively at a time to the sintered R-T-B based magnet bodies 1 and the sintered R-T-B based magnets would not stick to the sintered magnet body holding member 3 or the diffusion source holding member 4. As a secondary effect, in the RH supply-diffusion process step, the heavy rare-earth element RH can be deposited onto the sintered R-T-B based magnet bodies more uniformly and evenly. That is to say, the heavy rare-earth element RH can be supplied to even areas which would ordinarily be shadowed by the sintered magnet body holding member 3 or the diffusion source holding member 4.

(RH Diffusion Process Step)

The heavy rare-earth element RH is suitably made to further diffuse inside the sintered R-T-B based magnet by setting the pressure and temperature of the atmosphere in the process vessel to be within the range of 200 Pa to 2 kPa and the range of 800° C. to 950° C., respectively, after the RH supply-diffusion process step has been performed.

In this RH diffusion process step, by setting the pressure to be within the range of 200 Pa to 2 kPa, no heavy rare-earth element RH is supplied from the RH diffusion sources 2 anymore and only diffusion advances. For that reason, the sintered R-T-B based magnets will not stick to the sintered magnet body holding members 3 or the diffusion source holding members 4. In addition, by setting the temperature to be within the range of 800° C. to 950° C., the heavy rare-earth element RH can be made to diffuse even deeper inside the sintered R-T-B based magnets.

(Diffusion Processing System)

Figure 5:
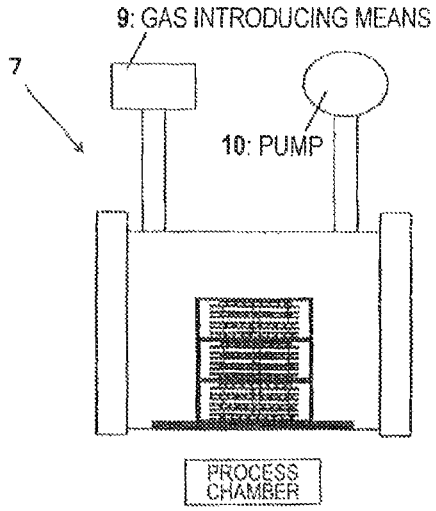
FIG. 5 Illustrates an exemplary diffusion processing system for performing an RH supply-diffusion process and other processes, wherein (*a*) illustrates a batch type diffusion processing system with only one process chamber and (*b*) illustrates a continuous diffusion processing system with multiple process chambers.
Figure 5:
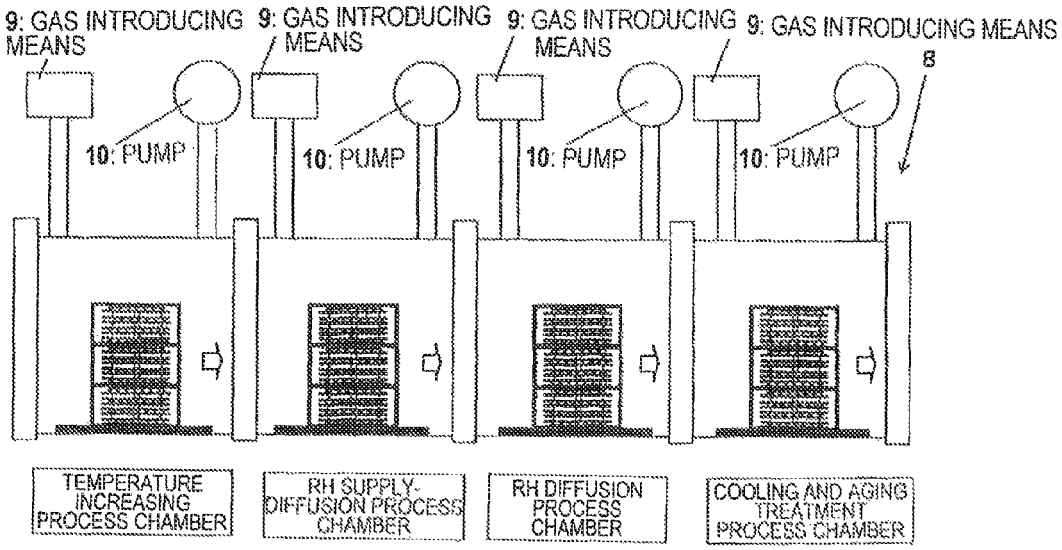
Figure 6:
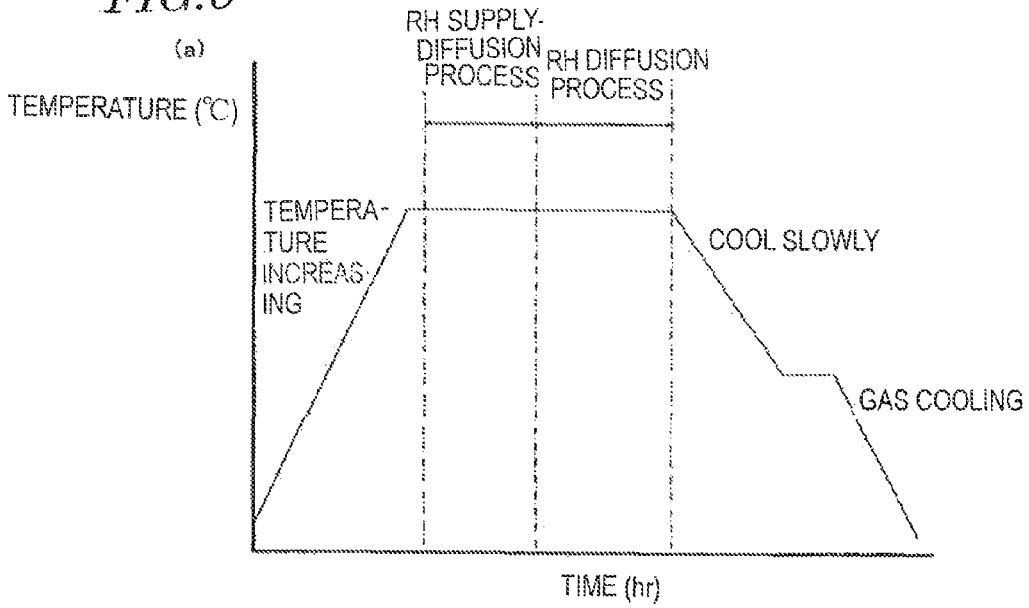
FIG. 6 (*a*) is a graph showing an exemplary heat treatment pattern to adopt when the system shown in FIG. 5(*a*) is used, and (*b*) is a graph showing an exemplary heat treatment pattern to adopt when the system shown in FIG. 5(*b*) is used.
Figure 6:
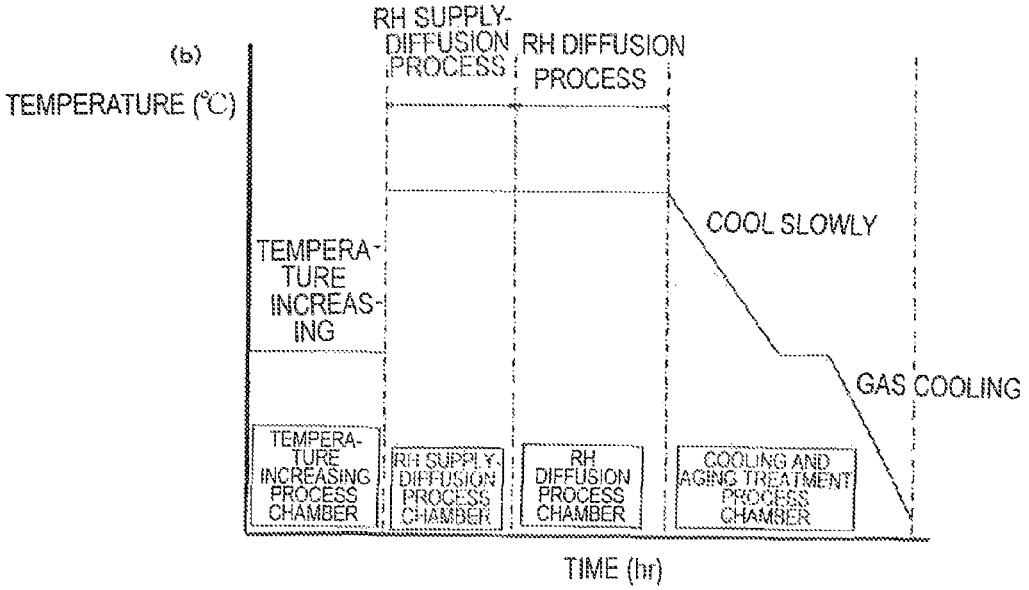
Figure 7:
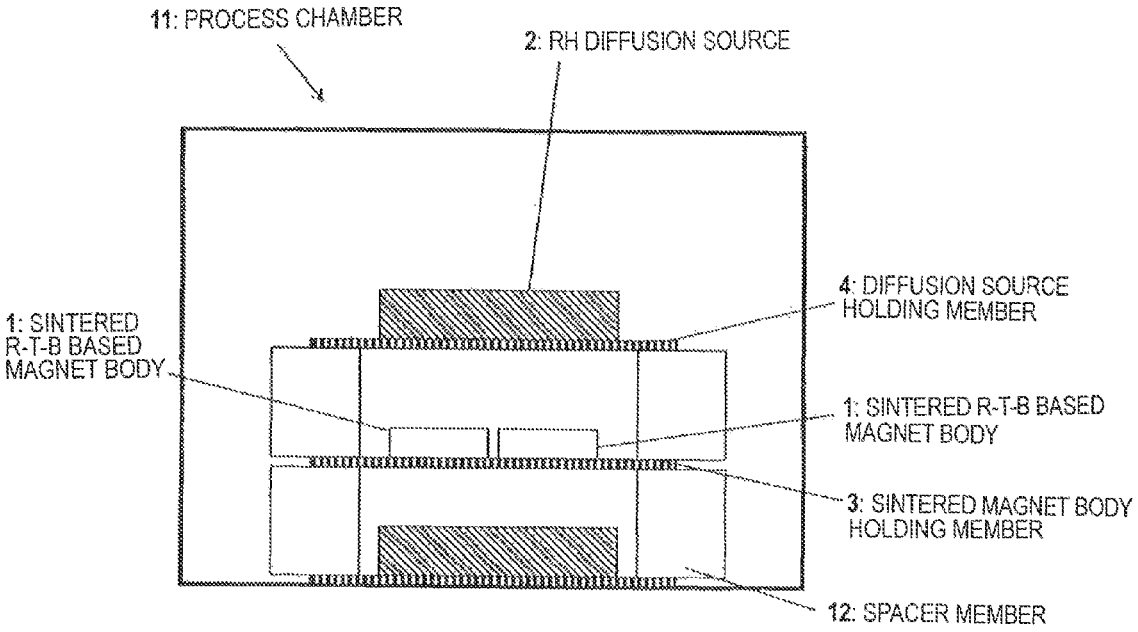
FIG. 7 PRIOR ART
FIG. 7 Illustrates an exemplary embodiment of Patent Document No. 1.

If the RH supply-diffusion process or RH diffusion process is carried out in a batch type diffusion processing system with only one process chamber as shown in FIG. 5(*a*), the diffusion process may be performed in a heat treatment pattern such as the one shown in FIG. 6(*a*). In that case, after the RH supply-diffusion process has been carried out in that process chamber, an inert gas is supplied into the chamber and has its atmospheric gas pressure adjusted to the range of 200 Pa to 2 kPa. And then the RH diffusion process described above is carried out.

On the other hand, if a continuous diffusion processing system with two process chambers, in which the RH supply-diffusion process and the RH diffusion process are supposed to be carried out, respectively, is used as shown in FIG. 5(*b*), then the heat treatment may be carried out in a heat treatment pattern such as the one shown in FIG. 6(*b*). In that case, the process chamber for the RH diffusion process has its atmospheric gas pressure and treatment temperature set in advance to be within the range of 200 Pa to 2 kPa and within the range of 800° C. to 950° C., respectively. The RH supply-diffusion process is carried out next in the process chamber for the RH supply-diffusion process. And then the process vessel is transported on a transporting stage (not shown) to the process chamber for the RH diffusion process and the RH diffusion process is carried out there.

It should be noted that the RH diffusion process and the RH supply-diffusion process do not always have to be carried out in the same system but may be carried out in two different systems. In the latter case, only the sintered R-T-B based magnets with or without the sintered magnet body holding member may be subjected to the RH diffusion process after having been subjected to the RH supply-diffusion process.

According to the present invention, the RH supply-diffusion process and RH diffusion process can be carried out at a relatively high pressure of about 0.1 Pa to about 2 kPa, and therefore, either a rotary pump or a rotary pump and a mechanical booster pump, which cannot produce a low pressure of $10^{-2}$ Pa or less, may also be used. That is why a pump that produces a low pressure such as a Cryo-pump as disclosed in Patent Document No. 2 is not necessarily needed.

(Heat Treatment)

Optionally, the sintered R-T-B based magnets which have been subjected to either the RH supply-diffusion process step or RH diffusion process step described above may be subjected to a heat treatment, which may be conducted by a known method.

(Surface Treatment)

In practice, the sintered R-T-B based magnets that have gone through the RH diffusion process are suitably subjected to some surface treatment, which may be a known one such as Al evaporation, electrical Ni plating or resin coating. Before the surface treatment, the sintered magnets may also be subjected to a known pre-treatment such as sandblast abrasion process, barrel abrasion process, etching process or mechanical grinding. Optionally, after the RH diffusion process, the sintered magnets may be ground to have their size adjusted. Even after having gone through any of these processes, $H_{cJ}$ hardly changes. For the purpose of size adjustment, the sintered magnets are suitably ground to a depth of 1 μm to 300 μm, more suitably to a depth of 5 μm to 100 μm, and even more suitably to a depth of 10 μm to 30 μm.

EXAMPLES

Example 1

A sintered R-T-B based magnet body, of which the composition included 22.3 mass % of Nd, 6.2 mass % of Pr, 4.0 mass % of Dy, 1.0 mass % of B, 0.9 mass % of Co, 0.1 mass % of Cu, 0.2 mass % of Al, 0.1 mass % of Ga and Fe as the balance, was made and then machined, thereby obtaining sintered R-T-B based magnet bodies 1, each having a thickness of 5 mm, a length of 40 mm and a width of 60 mm. When the sintered R-T-B based magnet bodies 1 thus obtained had their magnetic properties measured with a B-H tracer after having been subjected to a heat treatment (at 500° C.), $H_{cJ}$ was 1740 kA/m and $B_r$ was 1.30 T.

These sintered R-T-B based magnet bodies 1 were loaded into a process vessel comprised of the square tubular member 5 and the cap member 6 as shown in FIG. 1. Next, such process vessels were vertically stacked one upon the other on a base member 13 as shown in FIG. 2. In the process vessel, on the bottom of the square tubular member, a diffusion source holding member 4, an RH diffusion source 2, a sintered magnet body holding member 3, a set of sintered R-T-B based magnet bodies 1, another diffusion source holding member 4, another RH diffusion source 2, another sintered magnet body holding member 3, another set of sintered R-T-B based magnet bodies 1 and so forth were stacked one upon the other in this order, thereby forming a stack.

In this first example, sixteen sintered R-T-B based magnet bodies were arranged on each sintered magnet body holding member, which was a net of Mo, which had a thickness of 2 mm, a length of 200 mm and a width of 300 mm and which was a 4 mesh (with an opening size of 5.4 mm square) with a gap of 2.0 mm left between each pair of the sintered R-T-B based magnet bodies.

On the other hand, on each diffusion source holding member 4 which was made of the same material and had the same shape as the sintered magnet body holding member, arranged were seven RH diffusion sources which were made of Dy with a purity of 99.9% and of which the size was 3 mm×27 mm×270 mm.

The square tubular member had a length of 220 mm, a width of 320 mm and a height of 75 mm, while the cap member had a length of 220 mm, a width of 320 mm and a height of 2.0 mm.

The process vessels were loaded into the diffusion processing system shown in FIG. 5(*b*) and were subjected to an RH supply-diffusion process and a RH diffusion process under the temperature condition shown in FIG. 6(*b*).

Specifically, first, the process vessels were loaded into a temperature increasing process chamber, to which an inert gas was supplied with the pressure reduced with a pump in order to remove water, thereby setting the atmospheric gas pressure inside the furnace to be 40 Pa. Next, the inert gas was further supplied, thereby setting the atmospheric gas pressure inside the furnace to be 1.5 kPa and increasing the temperature to 450° C. Next, the process vessels were moved into an RH supply-diffusion process chamber, where an RH supply-diffusion process was carried out for two hours with the atmospheric gas pressure set to be 3.0 Pa after the temperature had been raised to 900° C.

After having gone through the RH supply-diffusion process, the process vessels were moved into an RH diffusion process chamber, where an RH diffusion process was carried out for six hours with the inert gas supplied again into the furnace and with the atmospheric gas pressure raised to 1.5 kPa.

When the RH diffusion process was over, the process vessels were moved into a cooling and aging treatment process chamber, where the process vessels were cooled from 900° C. to 500° C. at a cooling rate of 3° C./min and then rapidly cooled from 500° C. to room temperature by gas cooling (at a rate of 80° C./min). After that, a heat treatment was conducted at a pressure of 2 Pa and at a temperature of 500° C. for 60 minutes, thereby obtaining sintered R-T-B based magnets.

Example 2

Sintered R-T-B based magnets were made under the same condition as in the first example except that after the RH diffusion process had been carried out, the process vessels were rapidly cooled from 900° C. to room temperature by gas cooling (80° C./min).

Comparative Example 1

Sintered R-T-B based magnets were made under the same condition as in the first example except that the RH supply-diffusion process was carried out with the pressure in the process vessels set to be $10^{-3}$ Pa using a Cryo-pump and that sintered magnet body holding members mounting sintered R-T-B based magnet bodies and diffusion source holding members mounting RH diffusion sources were stacked one upon the other with spacer members interposed between them so that a gap of 8 mm was left between the sintered R-T-B based magnet bodies and the RH diffusion sources.

Comparative Example 2

Sintered R-T-B based magnets were made under the same condition as in the first example except that the RH supply-diffusion process was carried out with the pressure in the process vessels set to be $10^{-3}$ Pa using a Cryo-pump.

Comparative Example 3

Sintered R-T-B based magnets were made under the same condition as in the first example except that the RH supply-diffusion process was carried out with the pressure in the process vessels set to be $10^{-5}$ Pa using a Cryo-pump and then with an inert gas (Ar) introduced at a pressure of 40 kPa.

The following Table 1 summarizes not only respective processing methods and conditions but also resultant magnetic properties and whether sticking occurred or not as to Examples 1 and 2 and Comparative Examples 1, 2 and 3. After having been subjected to the heat treatment, each sintered R-T-B based magnet had its thickness reduced by 0.2 mm each time by grinding, thereby dicing the sintered R-T-B based magnet body into a number of magnets each having a thickness of 4.6 mm, a length of 7.0 mm and a width of 7.0 mm. Then, their magnetic properties were evaluated with a pulse excited B-H tracer. In Table 1, the "pressure" refers to the atmospheric gas pressure during the RH supply-diffusion process (i.e., the pressure in the process vessels), and the "distance" refers to the gap between the sintered R-T-B based magnet bodies 1 and the RH diffusion sources 2. In Examples 1 and 2 and in Comparative Examples 2 and 3, the "distance" corresponds to the thickness of 2 mm of the sintered magnet body holding members 3 and diffusion source holding members 4. In Comparative Example 1, on the other hand, the "distance" corresponds to the sum of 8 mm of the thickness of 2 mm of the sintered magnet body holding members 3 or diffusion source holding members 4 and the thickness of 6 mm of the spacer members. "$\Delta H_{cJ}$" means the difference between $H_{cJ}$ (of 1740 kA/m) of the sintered R-T-B based magnet bodies 1 yet to be processed and $H_{cJ}$ of the sintered R-T-B based magnet bodies 1 processed. "$\Delta B_r$" means the difference between $B_r$ (of 1.30 T) of the sintered R-T-B based magnet bodies 1 yet to be processed and $B_r$ of the sintered R-T-B based magnet bodies 1 processed. "Sticking occurred? How much if any?" indicates whether or not sticking occurred when the sintered R-T-B based magnets were removed from the sintered magnet body holding members 3 and the diffusion source holding members 4 and how much sticking occurred if the answer is YES. And "number of magnet bodies processed"

means the number of sintered R-T-B based magnet bodies processed at a time in Examples 1 and 2 and in Comparative Examples 1, 2 and 3.

TABLE 1

| | Pressure (Pa) | Distance (mm) | Δ HcJ (kA/m) | Δ Br (T) | Sticking occurred? How much if any? | Number of magnet bodies processed |
|---|---|---|---|---|---|---|
| Experimental example 1 | 3.0 | 2 | 400 | 0 | NO | 180 |
| Comparative example 1 | $10^{-3}$ | 2 | 430 | 0 | YES, locally | 138 |
| Experimental example 1 | 3.0 | 2 | 257 | 0 | NO | 180 |
| Comparative example 2 | $10^{-3}$ | 2 | NA | NA | YES, everywhere | 180 |
| Comparative example 3 | 40000 | 2 | 0 | 0 | NO | 180 |

As can be seen from Table 1, in Comparative Example 1, $H_{cJ}$ could be increased highly effectively without causing a decrease in $B_r$, but the number of magnet bodies processed in Comparative Example 1 was much smaller than in Examples 1 and 2 and sticking occurred locally to form bur projections in Comparative Example 1. In Comparative Example 2, on the other hand, sticking occurred too much to remove the sintered magnets from the holding members. In Comparative Example 3, no sticking occurred but no $H_{cJ}$ increasing effect ($\Delta H_{cJ}$) was confirmed. In contrast, in Example 1, no sticking occurred, $H_{cJ}$ could be increased (i.e., $\Delta H_{cJ}$ could be increased) almost as effectively as in Comparative Example 1, and a larger number of magnets could be processed by RH diffusion process at a time than in Comparative Example 1.

As can be seen from these results, the methods of Examples 1 and 2 are suitable for mass production and contribute to increasing the number of magnets processed by RH diffusion process at a time without allowing the sintered R-T-B based magnet bodies to stick to the holding members. Also, comparing Example 1 (that adopted a cooling rate of 3° C./min) to Example 2 (that adopted a cooling rate of 80° C./min), $H_{cJ}$ could be increased (i.e., Δ $H_{cJ}$ could be increased) more significantly in Example 1.

Example 3

The following Table 2 shows how $H_{cJ}$ varied according to the cooling condition after the RH supply-diffusion process had been carried out on the same condition as in Example 1. In Table 2, the "cooling conditions (1) through (8)" indicate the cooling rates from the temperature (of 900° C.) in the process vessels that had been subjected to the RH supply-diffusion process to 500° C. In any of these cases, the temperature was decreased rapidly from 500° C. to room temperature by gas cooling (at a rate of 80° C./min). According to the present invention, "room temperature" refers to the range of 20° C.±15° C. And "Δ $H_{cJ}$" means the difference between $H_{cJ}$ (of 1997 kA/m) of the sintered R-T-B based magnet obtained by rapidly decreasing the temperature in the process vessels to room temperature by gas cooling after the RH supply-diffusion process had been carried out (at 900° C.) (which is indicated by "standard" in Table 2) and $H_{cJ}$ of the sintered R-T-B based magnets that were subjected to the cooling process under the conditions (1) through (8).

Example 4

The following Table 3 shows the difference between $H_{cJ}$ of the sintered R-T-B based magnet as indicated by "standard" in Table 2 and $H_{cJ}$ of a sintered R-T-B based magnet that was made on the same condition as in Example 1 except that the temperature in the process vessels was decreased from 900° C. to room temperature at a cooling rate of 2° C./min after the RH supply-diffusion process had been carried out.

Example 5

The following Table 4 shows the difference between $H_{cJ}$ of the sintered R-T-B based magnet as indicated by "standard" in Table 2 and $H_{cJ}$ of a sintered R-T-B based magnet that was made on the same condition as in (4) through (7) in Table 2 except that the cooling process was carried out after the RH diffusion process.

TABLE 2

| Cooling condition (after RH supply-diffusion process) | ΔHcJ (kA/m) |
|---|---|
| (1) from 900° C. to 500° C. at 20° C./min | 5 |
| (2) from 900° C. to 500° C. at 15° C./min | 20 |
| (3) from 900° C. to 500° C. at 10° C./min | 63 |
| (4) from 900° C. to 500° C. at 5° C./min | 111 |
| (5) from 900° C. to 500° C. at 4° C./min | 129 |
| (6) from 900° C. to 500° C. at 3° C./min | 143 |
| (7) from 900° C. to 500° C. at 2° C./min | 157 |
| (8) from 900° C. to 500° C. at 1° C./min | 162 |
| (standard) from 900° C. to room temperature at 80° C./min | — |

TABLE 3

| Cooling condition (after RH supply-diffusion process) | ΔHcJ (kA/m) |
|---|---|
| from 900° C. to room temperature at 2° C./min | 152 |

TABLE 4

| Cooling condition (after RH diffusion process) | ΔHcJ (kA/m) |
|---|---|
| from 900° C. to 500° C. at 5° C./min | 116 |
| from 900° C. to 500° C. at 4° C./min | 134 |
| from 900° C. to 500° C. at 3° C./min | 147 |
| from 900° C. to 500° C. at 2° C./min | 160 |

As can be seen from Table 2, according to the cooling condition of 20° C./min (as indicated by (1) in Table 2), $H_{cJ}$ could hardly be increased. However, on every cooling condition of 15° C./min or less (as indicated by (2) through (8) in Table 2), $H_{cJ}$ could be increased effectively enough. That is why even though the temperature in the process vessels that have been subjected to the RH supply-diffusion process falls within the range of 800° C. to 950° C., the temperature is suitably decreased from that temperature range to 500° C. at a cooling rate of 1° C./min to 15° C./min. Also, the $H_{cJ}$ increasing effect was almost no different, no matter whether the cooling condition was 2° C./min (as indicated by (7) in Table 2) or 1° C./min (as indicated by (8) in Table 2). That is why considering the $H_{cJ}$ increasing effect and the productivity, the cooling rate is more suitably within the range of 2° C./min to 5° C./min and most suitably falls within the range of 2° C./min to 3° C./min.

Furthermore, even if the temperature in the process vessels was decreased at a cooling rate of 2° C./min from 900° C. to room temperature as shown in Table 3 after the RH supply-diffusion process had been carried out, $H_{cJ}$ could also be increased as effectively as in a situation where the temperature was decreased from 900° C. to 500° C. at a cooling rate of 2° C./min and then to room temperature by gas cooling (as indicated by (7) in Table 2). For that reason, considering the productivity, it is recommended that the temperature be decreased rapidly from 500° C. to room temperature.

Furthermore, as can be seen from Table 4, according to these cooling conditions, $H_{cJ}$ could be increased effectively to almost the same degree, no matter whether the cooling process was carried out after the RH supply-diffusion process or after the RH diffusion process.

REFERENCE SIGNS LIST

1 sintered R-T-B based magnet body
2 RH diffusion source
3 sintered magnet body holding member
4 diffusion source holding member
5 square tubular member
6 cap member
7 batch type diffusion processing system
8 continuous diffusion processing system
9 gas introducing means
10 pump
11 process vessel
12 spacer member
13 base member

The invention claimed is:

1. A method for producing a sintered R-T-B based magnet, the method comprising the steps of:

forming a stack of RH diffusion sources (which are made of a metal or alloy, of which at least 80 at % is a heavy rare-earth element RH that is at least one of Dy and Tb) and sintered R-T-B based magnet bodies (where R is at least one of the rare-earth elements and T is at least one of the transition metal elements and always includes Fe) by stacking the diffusion sources and the magnet bodies alternately with a holding member having openings interposed;

carrying out an RH supply-diffusion process by loading the stack into a process vessel and creating an atmosphere with a pressure of 0.3 Pa to 50 Pa and a temperature of 800° C. to 950° C. within the process vessel, wherein throughout the RH supply-diffusion process, the pressure is maintained between 0.3 Pa to 50 Pa and the temperature is maintained between 800° C. to 950° C.; and carrying out an RH diffusion process by creating an atmosphere with a pressure of 200 Pa to 2 kPa and a temperature of 800° C. to 950° C. in the process vessel after the RH supply-diffusion process has been carried out, wherein throughout the RH diffusion process, the pressure is maintained between 200 Pa to 2 kPa and the temperature is maintained between 800° C. to 950° C.

2. The method of claim 1, wherein the holding member has a thickness of 0.1 mm to 4 mm.

3. The method of claim 1, further comprising decreasing the temperature in the process vessel to 500° C. at a cooling rate of 1° C. per minute to 15° C. per minute after either the RH supply-diffusion process or the RH diffusion process has been carried out.

4. The method of claim 1, wherein the process vessel is evacuated using a rotary pump with or without a mechanical booster pump.

* * * * *